US008261754B2

(12) United States Patent
Pitstick

(10) Patent No.: US 8,261,754 B2
(45) Date of Patent: Sep. 11, 2012

(54) NAIL FILE HAVING A FLEXIBLE FILING STRIP

(75) Inventor: Ronald J. Pitstick, Union, OH (US)

(73) Assignee: Ganghut Ltd., Glasgow Scotland (GB)

( * ) Notice: Subject to any disclaimer, the term of this patent is extended or adjusted under 35 U.S.C. 154(b) by 0 days.

(21) Appl. No.: 12/738,142

(22) PCT Filed: Nov. 24, 2008

(86) PCT No.: PCT/US2008/084525

§ 371 (c)(1),
(2), (4) Date: Apr. 15, 2010

(87) PCT Pub. No.: WO2009/070528

PCT Pub. Date: Jun. 4, 2009

(65) Prior Publication Data

US 2010/0224203 A1 Sep. 9, 2010

Related U.S. Application Data

(60) Provisional application No. 60/990,001, filed on Nov. 26, 2007.

(51) Int. Cl.

| | |
|---|---|
| ***A45D 29/18*** | (2006.01) |
| ***A45D 29/04*** | (2006.01) |
| ***A45D 29/00*** | (2006.01) |
| ***A61C 15/00*** | (2006.01) |

(52) U.S. Cl. ..... 132/76.4; 132/75.6; 132/73; 132/323

(58) Field of Classification Search ..... 132/75.6, 132/73, 73.5, 76.4, 75.8, 75.3, 73.6

See application file for complete search history.

(56) References Cited

U.S. PATENT DOCUMENTS

| | | | | |
|---|---|---|---|---|
| 893,004 | A * | 7/1908 | Miller | 132/76.4 |
| 1,370,753 | A * | 3/1921 | Loring | 132/76.4 |
| 1,492,470 | A * | 4/1924 | Kirby | 132/75.6 |
| 1,533,664 | A * | 4/1925 | Sanford | 132/73 |

(Continued)

FOREIGN PATENT DOCUMENTS

KR 1019990021584 10/1999

(Continued)

OTHER PUBLICATIONS

International Search Report, Application No. PCT/US2008/084525, 2 pages, Apr. 7, 2009.

*Primary Examiner* — Robyn Doan
(74) *Attorney, Agent, or Firm* — Dinsmore & Shohl LLP

(57) ABSTRACT

A filing strip having a support portion, an abrasive portion, and at least two edge portions is provided. The support portion provides a groove that extends at least partially along a longitudinal axis of the support portion, and has a degree of flexibility sufficient to flexes under pressure applied with the insertion of an end of a human nail into the groove. The abrasive portion is positioned within the groove so as to file the end of the human nail inserted into the groove. The edge portions are positioned at least partially along an upper periphery and a lower periphery of the groove, respectively, to define a depth of the groove to limit the insertion of the human nail into the groove and to ensure only the end of the nail and not surrounding flesh to the human nail is filed by the abrasive portion.

16 Claims, 7 Drawing Sheets

U.S. PATENT DOCUMENTS 1,831,327 A * 11/1931 Surdock ..... 132/73.6
2,019,580 A * 11/1935 Poux ..... 132/75.6
2,566,688 A * 9/1951 West ..... 132/76.4
5,007,441 A * 4/1991 Goldstein ..... 132/73.6
5,033,485 A * 7/1991 Hauerwas et al. ..... 132/73.6
5,732,719 A 3/1998 Godbout
5,816,266 A 10/1998 Cone
7,137,396 B2 * 11/2006 Okane ..... 132/200
2008/0149125 A1 * 6/2008 Karcher ..... 132/200

FOREIGN PATENT DOCUMENTS

KR 20-0436647 9/2007

* cited by examiner

NAIL FILE HAVING A FLEXIBLE FILING STRIP

The present invention is related to a nail file, and in particular to a nail file having a flexible filing strip with a concave surface or groove providing an abrasive portion situated between smooth upper and lower edges or quick stops.

Conventional sheet like nail files (i.e., flat emery boards) specific for nail filing are not ideal in use. With reference to FIGS. 7A and 7B, this is because typically a nail 22 after being cut with a conventional nail clipper (not shown) will have sharps rough ends and/or edges at each corner terminuses of the nail 22, and also at the front and back of the nail end 24 that can be hurtful. In addition, conventional nail clippers typically will leave flat spots 27 along the nail end 24. As the sharp rough ends 24 and flat spots 27 are distributed untidily along the nail end 24, conventional sheet like nail files do not have sufficient surface contact to file away the sharp rough ends 24 or flat spots 27 evenly, and thus can result in over filed or missed spots when filed with sheet like nail files.

It is against the above background that the present invention provides a nail file convenient for holding and largely increasing the efficiency of filing nails of fingers and toes to smooth out sharp rough ends and flat spots typically caused by conventional nail clippers.

In one embodiment, the nail file provides a flexible filing strip having a support section with a concave channel or groove providing an abrasive portion situated between smooth upper and lower edge portions or quick stops. The groove and quick stops are dimensioned and shaped such that nail end can be filed smooth into a uniformly rounded end without damaging the quick or skin surrounding the nail. In addition, the longitudinally extending curvature of the groove is controlled by an applied pressure to the flexible filing strip, such as the pressing of the nail end against the groove, to provide a degree of wrap to the filing strip around the end of the nail. Accordingly, with the desired degree of wrap provided and bi-directional lateral movement of the nail file, the filing strip will also smoothly file the nail end eliminating any flat spots found along the end of the nail.

Although not limited thereto, the following features of a nail file according to the present invention are provided. The present invention files a uniform rounded end of the nail. The flexible design of the filing strip helps prevent flat spots along the nail end. A smooth quick stop of the filing strip prevents over filing while leaving an even nail length. Accordingly, a smooth even surface to the nail end can be filed with the present invention even if paying very little attention to the filing of the nail. For safety reasons, the filing strips have no exposed cutting surfaces or pointed ends. In addition, the handles, in both the disposable and reusable embodiments, provide an overall shape which does not pose as a stabbing, poking or cutting hazard.

In one exemplary embodiment, a filing strip for filing an end of a human nail is disclosed. The filing strip comprises a support portion, an abrasive portion, and at least two edge portions. The support portion comprises a groove that extends at least partially along a longitudinal axis of the support portion. The support portion has a degree of flexibility sufficient to define a longitudinally extending curvature of the support portion which flexes under pressure applied with the insertion of the end of the human nail into the groove such that the groove wraps at least partially about the end of the human nail. The abrasive portion is positioned within the groove of the support portion and extends at least partially along the longitudinal axis of the support portion so as to file the end of the human nail inserted into the groove and in contact with the abrasive portion. The edge portions are positioned at least partially along an upper periphery and a lower periphery of the groove, respectively, to define a depth of the groove to limit the insertion of the human nail into the groove and to ensure only the end of the nail and not surrounding flesh to the human nail is filed by the abrasive portion.

Optionally, the support portion may further comprise at least one connective feature disposed at an end of the support portion to connect the filing strip to a filing device to facilitate the filing of the end of the human nail by the filing strip. Further, the abrasive portion may comprise a measure of abrasion selected from the group consisting of: fine abrasion, medium abrasion, and coarse abrasion. The abrasive portion may comprise at least one of an abrasive material embedded in the support portion, an abrasive material adhered to the support portion, and a roughened, knurled, or sharp surface provided to the support portion. For example, the abrasive portion may be an emery provided to the support portion.

In another exemplary embodiment, a nail file comprises a filing strip and a handle. The filing strip comprises a support portion, an abrasive portion, and at least two edge portions. The support portion comprises a groove that extends at least partially along a longitudinal axis of the support portion. The support portion has a degree of flexibility sufficient to define a longitudinally extending curvature of the support portion which flexes under pressure applied with the insertion of the end of the human nail into the groove such that the groove wraps at least partially about the end of the human nail. The abrasive portion is positioned within the groove of the support portion and extends at least partially along the longitudinal axis of the support portion so as to file the end of the human nail inserted into the groove and in contact with the abrasive portion. The edge portions are positioned at least partially along an upper periphery and a lower periphery of the groove, respectively, to define a depth of the groove to limit the insertion of the human nail into the groove and to ensure only the end of the nail and not surrounding flesh to the human nail is filed by the abrasive portion. The handle comprises a grip portion, at least two arms, and at least two connective features that complement the connective features of the filing strip. The filing strip is connected to the handle via the complementary connective features respective of the support portion and the handle.

Optionally, the connective features of the support portion may be keyholes and the connective features of the handle may be ball ends disposed on respective ends of the arms. The keyholes of the support portion may respectively comprise a large arc portion interconnected with a small arc portion and the arms of the handle may comprise a degree of flexibility sufficient to permit the arms to flex such that the ball ends insert into the large arc portions of the keyholes and neck portions between the ball ends and the arms slide into the small arc portions of the keyholes with release of flexion of the arms such that the filing strip is removably connected to the handle. Further, the arms of the handle may comprise a degree of flexibility sufficient to facilitate the wrapping of the groove of the support portion at least partially about the nail end inserted therein. The nail file may comprise an electrically powered motor inside of the handle and a power control switch at least partially exposed along an exterior surface of the handle and the motor may drive bi-directional lateral movement of the filing strip to file the nail. The nail file may comprise a plug electrically coupled to the motor and the power switch and extending from the handle. The nail file may comprise a battery receptacle electrically coupled to the motor and the power switch. The power switch may be actuated to activate the motor and the bi-directional lateral movement of the filing strip with the insertion of the nail into the groove of the support portion of the filing strip. Alternatively, the power switch may be spring-biased and positioned beneath the filing strip such that the spring-biased power switch is substantially simultaneously depressed via a finger or toe associated with the nail to activate the motor with the insertion of the nail end into the groove of the support portion. In the alternative, the power switch may be discretely manually actuated by the user to activate the motor.

These and other features and advantages of the present invention will become apparent after reading the detailed description of the various embodiments thereof in reference to the accompanying drawings.

The present invention is illustrated by way of example and not with limitations in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention. In addition, throughout the specification, and in the claims, the meaning of "a", "an", and "the" may include plural references. The meaning of "in" includes "in" and "on". Also, "battery" includes single cell batteries and multiple cell batteries.

Figure 1:
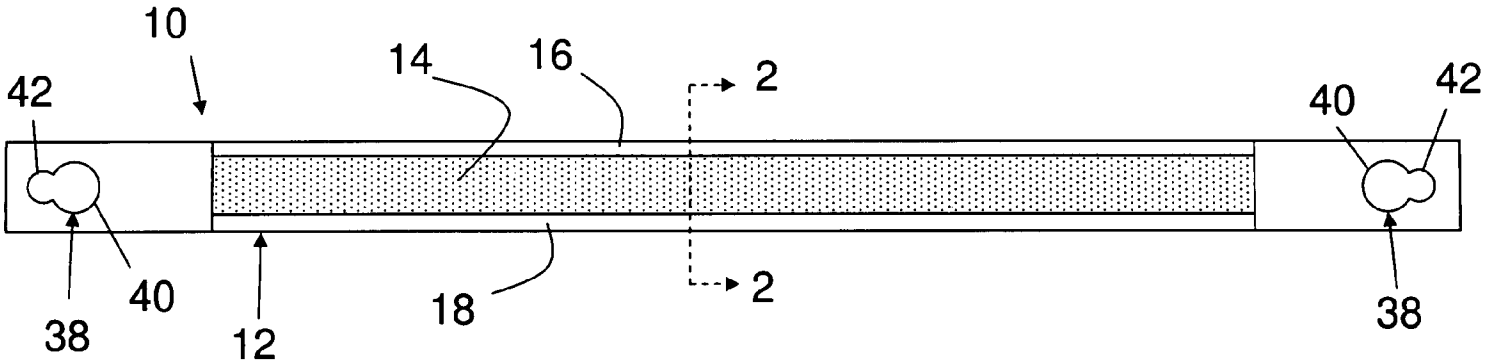
FIG. 1 is a perspective top view showing an embodiment of a nail filing strip according to the present invention.
Figure 2:
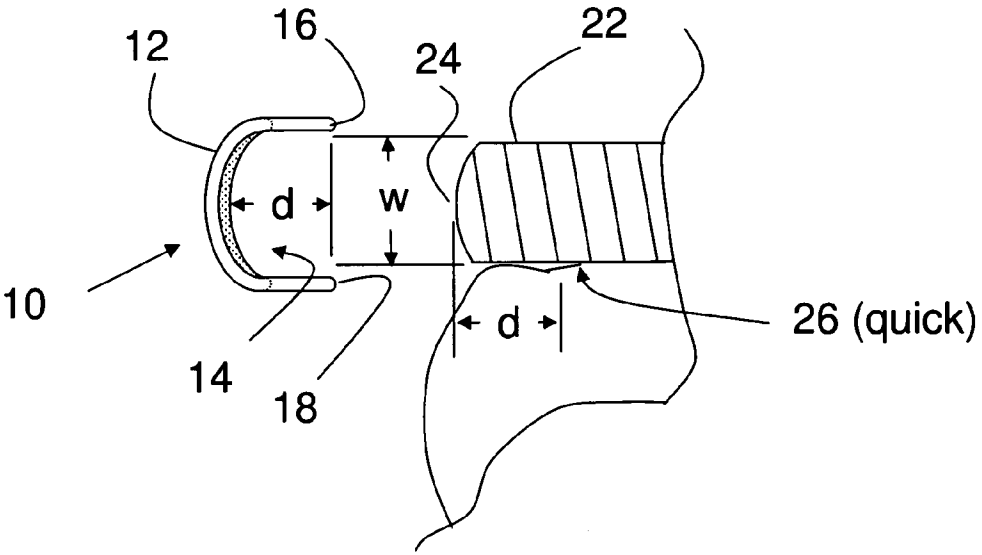
FIG. 2 is a sectional view of the nail filing strip of the present invention taken along section line 2-2 in FIG. 1, and shown in close proximity to a nail end that has been filed smooth into a uniformly rounded end by the present invention.
Figures 7A, 7B:
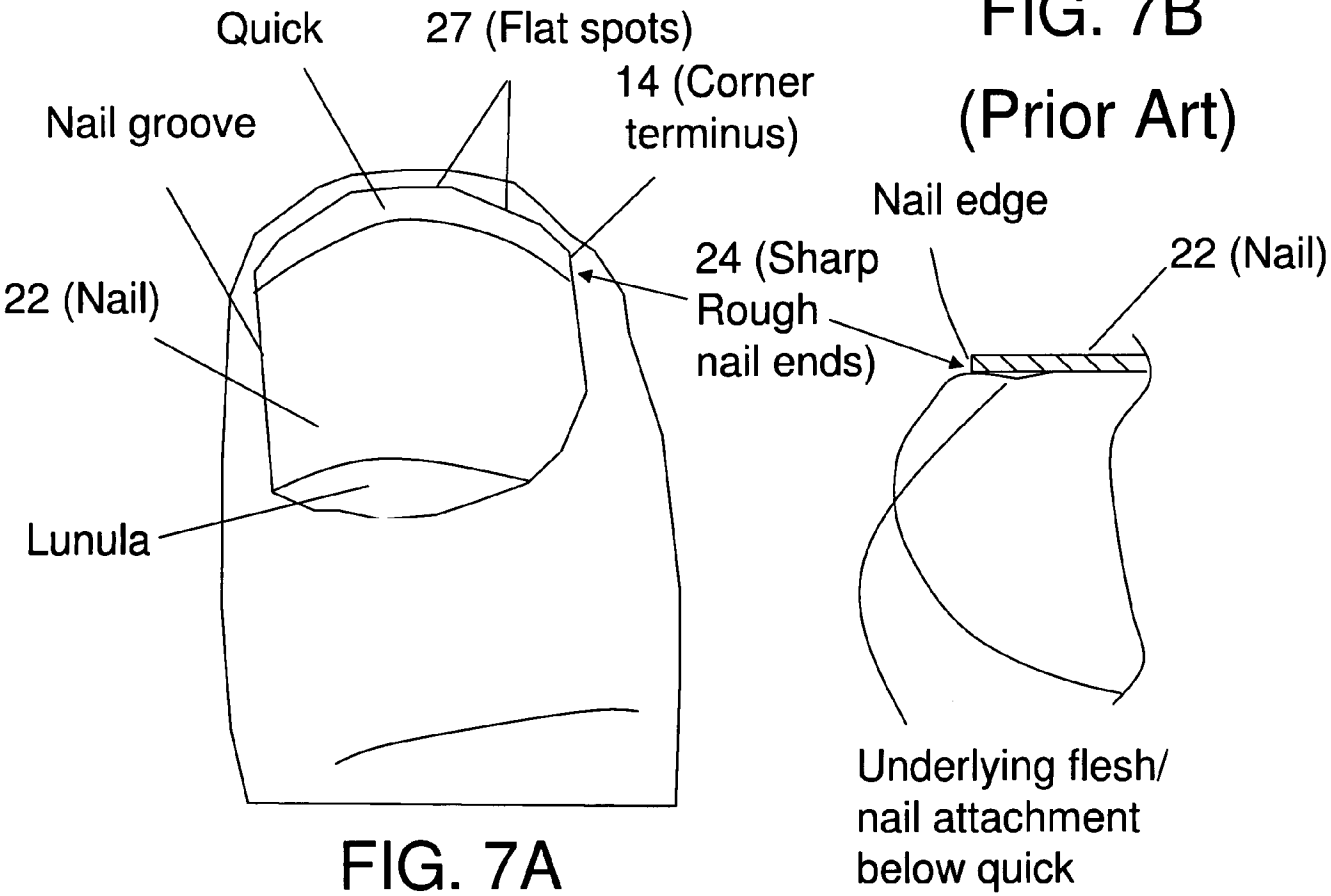
FIG. 7B (Prior Art)
FIG. 7A (Prior Art)
FIGS. 7A and 7B are schematic front and side sectional views of a thumb having flat spots and sharp rough nail ends after clipping with a conventional nail clipper.

Referring firstly to FIGS. 1 and 2, a flexible filing strip 10 is provided by the present invention and comprises a support portion 12, an abrasive portion 14, and at least two edge portions 16, 18. The support portion 12 comprises a groove 20 that extends at least partially along a longitudinal axis of the support portion 12. The support portion may also comprise at least one connective feature, which generally is disposed at each end of the support portion 12 to connect the filing strip 10 to a filing device, such as a nail file, to facilitate the filing of an object, such as a human nail. The abrasive portion 14 is positioned at least partially in a concave channel or groove 20 between smooth upper and lower edges or quick stops 16, 18. The groove 20 and quick stops 16, 18 are dimensioned and shaped such that an end 24 of a nail 22 (FIG. 7B) can be filed smooth into a uniformly rounded edge without damaging the quick 26 or skin surrounding the nail 22. More particularly, the quick stops 16, 18 are positioned at least partially along an upper periphery and a lower periphery, respectively, to define the depth of the groove 20 to limit the insertion of a nail end 24 into the groove 20 and to define a width of the groove 20 to preclude insertion of a portion of the nail 22 other than the nail end 24 into the groove 20 and in contact with the abrasive portion 14.

In one embodiment, the filing strip 10 of the present invention is approximately about 3 inches to about 3.5 inches in length, and has a groove with a width (w) of approximately about 2 millimeters to about 4 millimeters. The selection of the length and width used is user dependent. For example, filing strips for infants, children, adult women, and adult men will all have different lengths and widths and are selected to best suited the majority of each type of user. In most cases, the width (w) is slightly larger than the width of the nail 22 as shown by FIG. 2. In addition, a depth (d) of the groove 20, and hence the length of the quick stops 16, 18, also depends on the desired length of the nail 22 when utilizing the quick stops 16, 18. In most embodiments, the depth (d) of the groove 20 as determined by the length of the quick stops 16, 18, will be approximately about 2 millimeters to about 4 millimeters deep, and will correspond to less than or equal to the depth of the quick 26 from the finished rounded end 24 of the nail 22 for each user type (infant, child, women, male).

In one embodiment, the filing strip 10 is made from a metal, a polymer, a fibrous/natural materials, and combinations thereof. In one specific plastic embodiment, selection of the density may vary from softer to harder, which also will depend on the user type, i.e. infants, children, adult women and men. It is also intended that the filing strip 10 will provide the abrasive portion 14 in at least three different versions with a measure of abrasion ranging from fine, medium, and coarse. In other specific embodiments, the filing strip 10 may be provided using one or more of the following production materials: semi soft plastic, vinyl, etc. with the abrasive portion 14 being provided as either an embedded or adhered abrasive material of varying weights for different filing needs.

In still another embodiment, the filing strip 10 is provided as a thin, flexible, single piece of a polymer or metal, like aluminum, formed to provide the desired U-shaped groove 20 with the smooth upper edges or quick stops 16, 18, and with a roughened surface, e.g., knurling, which acts as the abrasive portion 14. In still another embodiment, the filing strip 10 is a stainless steel chain designed in the U-shaped configuration, i.e., provided with groove 20 and quick stops 16, 18, with roughened or sharp inner surface, which acts as the abrasive portion 14. The present invention in yet another embodiment may be provided as an emery or as a heavy paper, similar to that of standard emery boards, formed into the U-shaped groove 20 with adhered abrasive material acting as the abrasive portion 14 and having the smooth upper edges or quick stops 16, 18. In a metal and plastic combination embodiment, the abrasive portion 14 may be provided as a thin metal, continuous or linked, with a roughened or sharp cutting surface and a plastic molded around it for safety and providing the quick stops 16, 18.

Figure 3A:
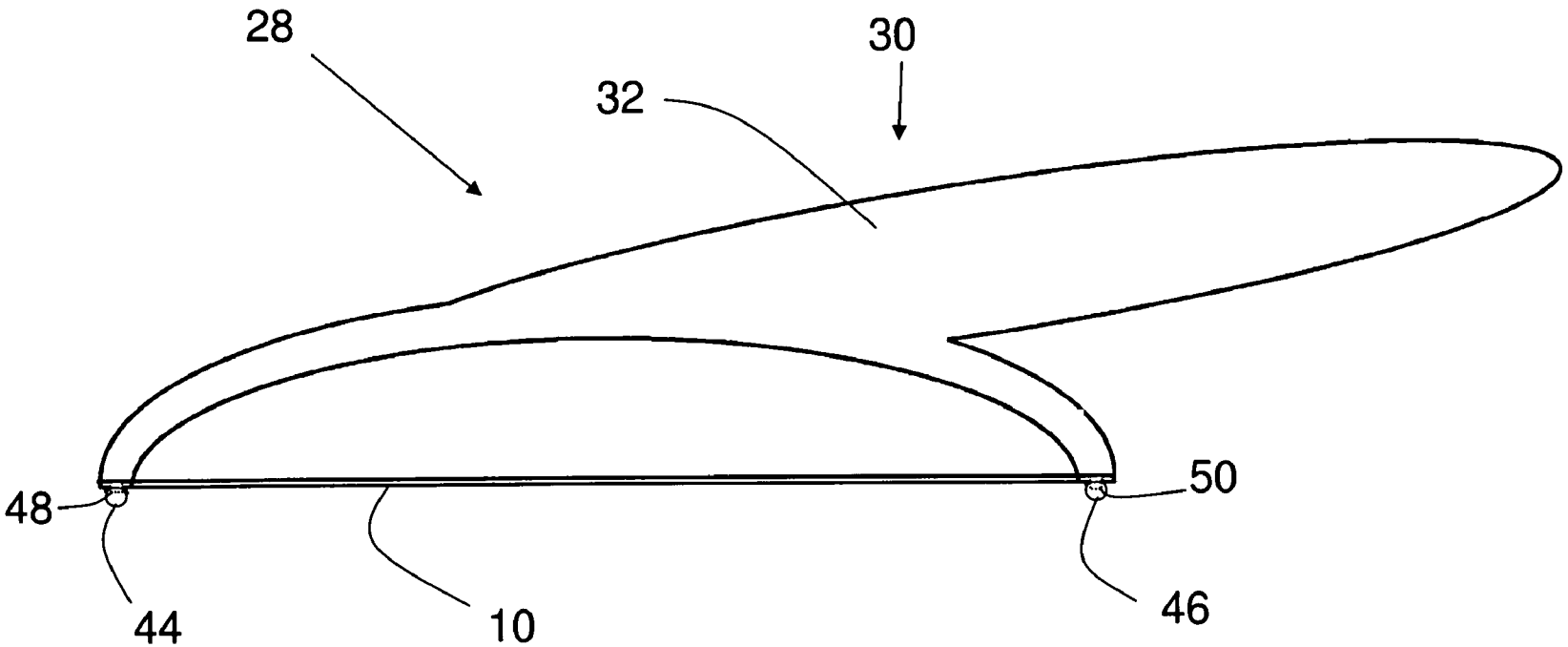
FIG. 3A is a side view of a partially disposable nail file embodiment according to the present invention holding releasably the filing strip of FIG. 1 and being in a nonuse state.
Figure 3B:
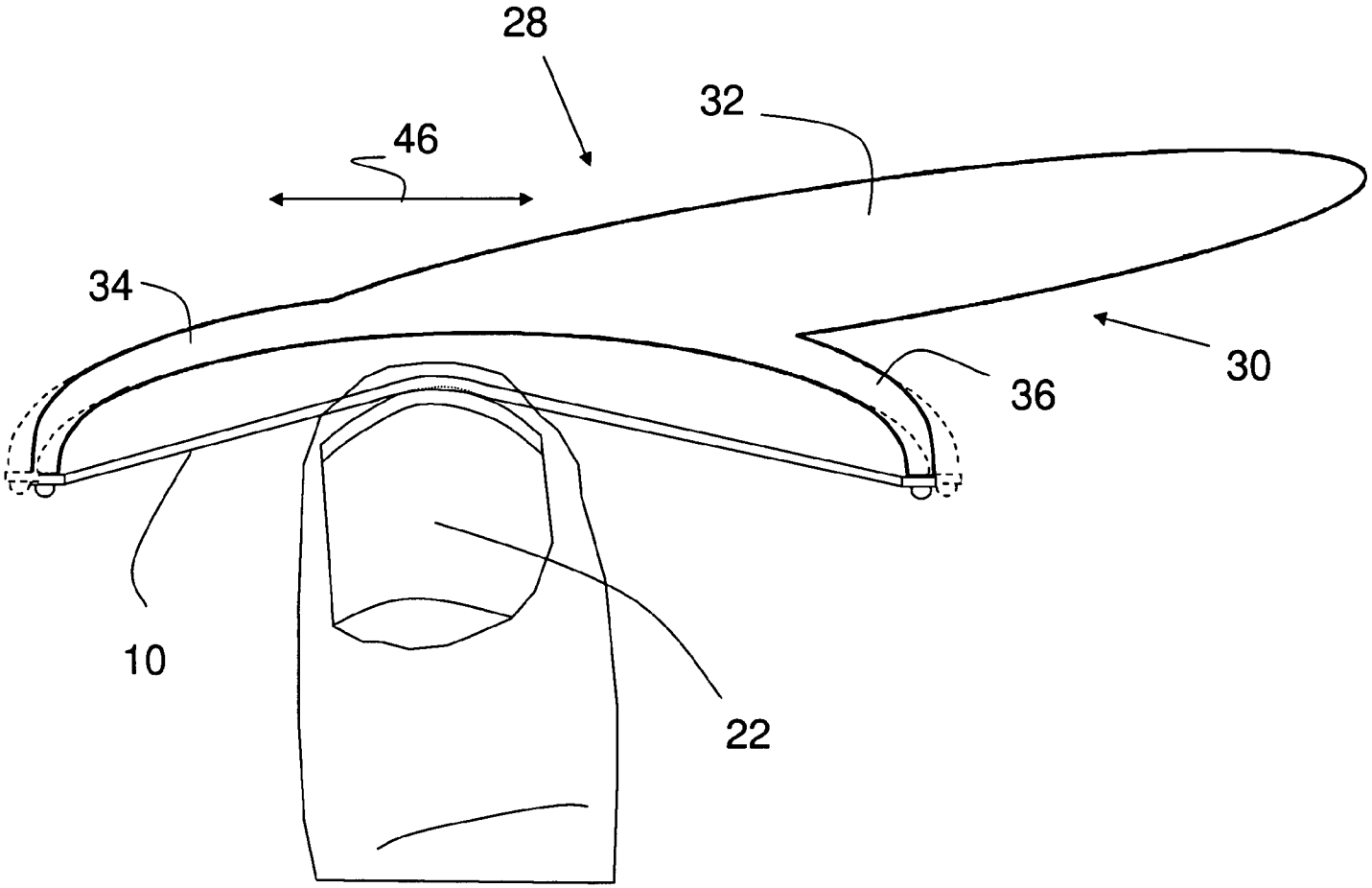
FIG. 3B is a side view of the nail file embodiment of FIG. 3A and being in a use state filing a uniformly rounded end to a nail and showing the longitudinally extending curvature of a groove in which the nail is engaged being controlled by the pressing of the nail end against the groove, thereby providing a degree of wrap to the filing strip around the end of the nail.

Turning now to FIGS. 3A and 3B, an embodiment of a nail file 28 according to the present invention is shown. In this embodiment, the filing strip 10 is disposable and easily attaches removable to a handle 30, which may be reusable. The reusable handle 30 is made from either metals, polymers, fibrous/natural materials, and may vary in style and desirability, such as for example, from an attractive Rosewood for a man to solid gold with diamond studs for those users with expensive taste. The handle 30 may also be shaped into anything, such as for example, a standard comb-like look as illustrated by FIG. 3A, to a cartoon character that is desirable to children.

The handle 30 generally comprises a grip portion 32 for a user to grip the handle 30, at least two arms 34, 36, and at least two connective features. The connective features of the handle 30 generally complement the connective features of the support portion 12 of the filing strip 10. As such, the filing strip 10 may be connected to the handle 30 via the complementary connective features of the filing strip and the handle. For example, as shown by FIG. 1, as a releasable attachment example, the filing strip 10 in one embodiment provides a pair of keyholes 38 having a large arc 40 and a small arc 42. Respective connective features, shown here as ball ends 44, 46, of the handle 30 first fit into the large arc portion 40 of their respective keyhole 38 via slightly deforming the handle 30 at one of the ends. After insertion, neck portions 48, 50 between each of the ball ends 44, 46 and the handle 30, seat into the small arc portion 42 due to the handle 30 returning to its normal shape, thereby mounting the filing strip 10 releasably to the handle 30, as is shown in FIG. 3A. Other releasable attachment methods may be used and are envisioned with the present invention. It is further to be appreciated that the ball ends 44, 46 serve a dual purpose. In addition to serving as an attachment point to the filing strip 10, a user may tap the ball ends 44, 46 against a hard surface to clean any nail filings from the groove 20 after use, thereby keeping the abrasive portion 14 clean and ready for the next use.

Figure 3C:
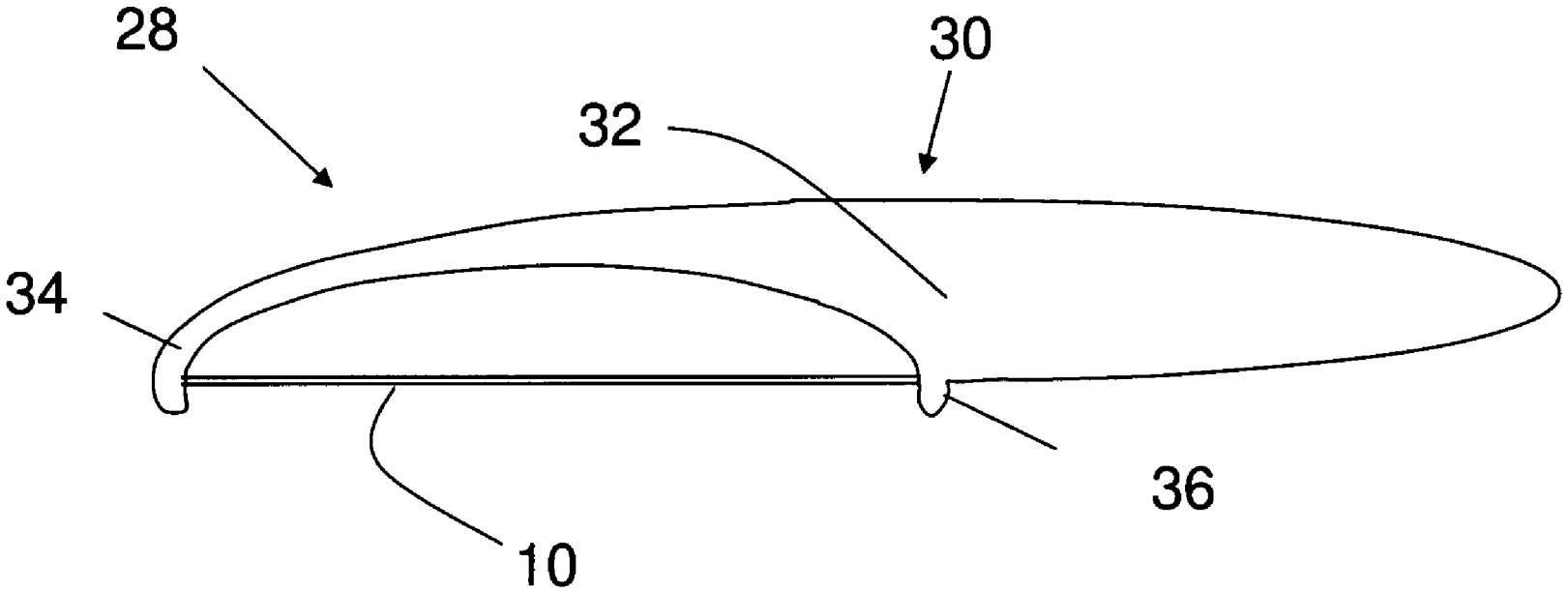
FIG. 3C is a side view of a fully disposable nail file embodiment according to the present invention integrally provided with a filing strip having at least the groove and quick stops of the filing strip of FIG. 1.

In another embodiment shown by FIG. 3C, the nail file 28 is fully disposable, wherein the filing strip 10 is fixed or made integral to a handle 30. For example, the handle may be blow molded to the filing strip, or the filing strip and handle can be blow molded as a unity piece.

As shown by FIGS. 3B and 3C, in both the partially and fully disposable embodiments, respectively, the handle 30, due to bow like shaped arms 34, 36, provides a degree of flexibility that facilitates the wrapping of the groove 20 of the filing strip 10 around the end 24 of the nail 22. Further flex is also provided by the flexibility of the filing strip 10. More particularly, the support portion 12 of the filing strip 10 generally comprises a degree of flexibility sufficient to define a longitudinally extending curvature of the support portion 12 flexed under pressure applied with the insertion of the projecting portion of the object (i.e., human nail 22) into the groove such that the groove wraps at least partially about the projecting portion of the object, or the nail end 24 of the nail 22. Accordingly, the longitudinally extending curvature of the groove 20 (FIG. 1) is controlled in use by an applied pressure to the flexible filing strip 10, such as the pressing of the nail 22 against the groove 20 as shown by FIG. 3B, to provide a degree of wrap to the filing strip 10 around the end of the nail 22. In use, with the desired degree of wrap provided and side to side movement of the nail file 28 (indicated by arrow 46), the filing strip 10 will smoothly file the nail end 24 to eliminate any flat spots.

Figure 4:
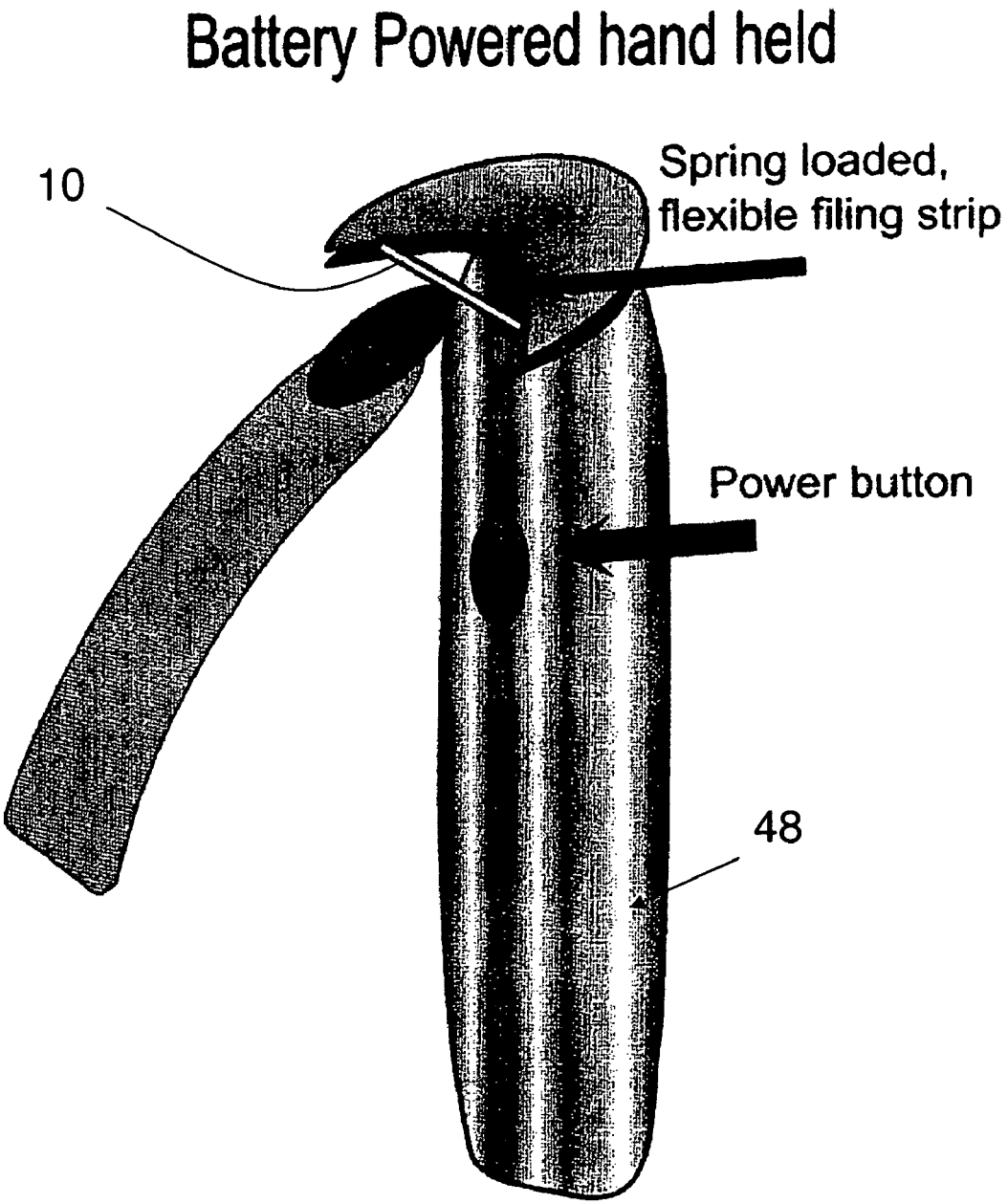
FIG. 4 is a perspective elevational view showing another nail file embodiment of the present invention provided as a battery powered hand held device driving a filing strip according to the present invention.
Figure 5:
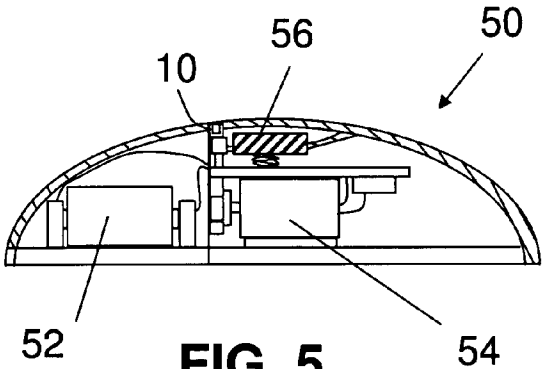
FIG. 5 is a side schematic, partial sectional view showing another nail file embodiment of the present invention provided as a powered desk top device driving a filing strip according to the present invention.

Electrically-powered embodiments of nail files 28 employing a filing strip 10 having the groove 20 and quick stops 16, 18 (FIG. 2) according to the present invention are also shown. For example, FIG. 4 is a perspective elevational view showing another nail file embodiment of the present invention provided as battery powered hand held device 48 driving the filing strip 10 according to the present invention in the bi-directional lateral movement. The filing strip 10 may be either disposable or permanently attached to device 48. In still another embodiment, FIG. 5 shows the present invention provided as a desk top device 50 driving a filing strip 10 according to the present invention in the bi-directional lateral movement. The filing strip 10 may be either disposable or permanently attached to device 50. In another embodiment, either of the devices 48 or 50, and their respective motors and power switches, may be electrically coupled to and powered by a power cord or plug connected to an electrical outlet.

Figure 6:
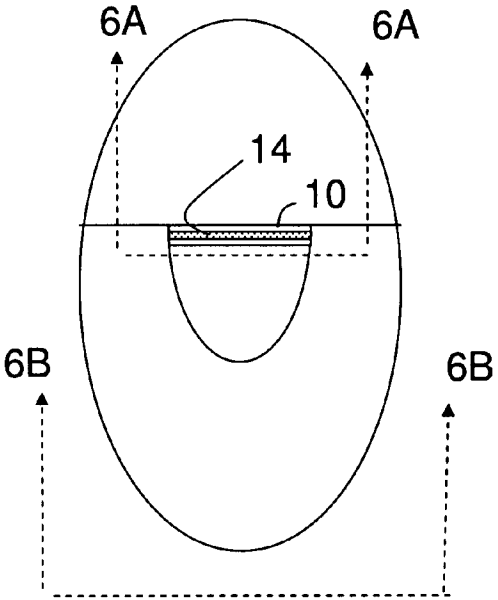
FIG. 6 is a top view of the desk top device of FIG. 5 unsectioned.
Figure 6B:
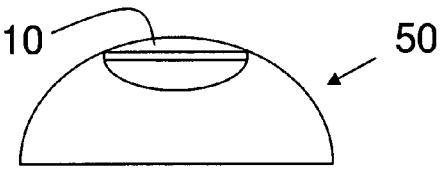
FIG. 6B is a side view of the desk top device taking along line 6B-6B in FIG. 6.
Figure 6A:
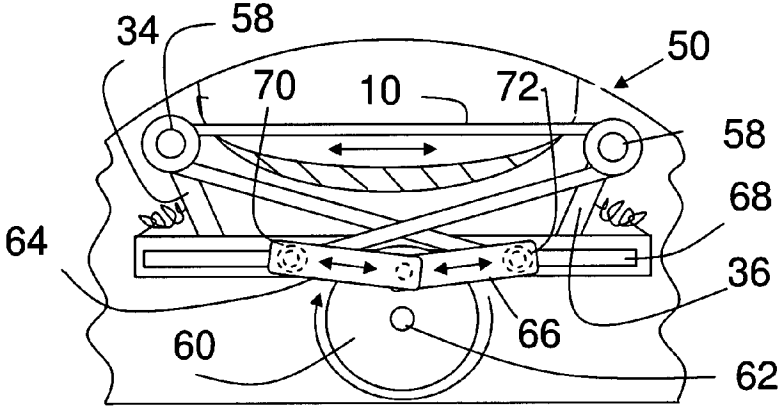
FIG. 6A is a partially enlarged schematic side view taking along section line 6A-6A in FIG. 6, and showing one means of providing a rotary to bi-directional lateral movement to drive the side to side motion of the filing strip in the desk top device.

As shown by FIG. 5, the desk top device 50 has a battery 52 powering a motor 54 which effectuates the side to side motion of the filing strip 10. As shown by FIG. 6, which is a top view of the desk top device 50 of FIG. 5 unsectioned, the nail 22 of the user will engage the groove 20 of the filing strip 10 from above. Pressing the nail 22 into the groove 20 will cause a power switch 56 (best shown by FIG. 5) to be depressed, thereby activating the motor 54 and causing the bi-directional lateral movement of the filing strip 10. FIG. 6A is a partially enlarged schematic side view taking along section line 6A-6A in FIG. 6, and shows one approach to providing a rotary to bi-directional lateral movement to drive the side to side motion of the filing strip 10 in the desk top device 50. FIG. 6B is a side view of the desk top device 50 taking along line 6B-6B in FIG. 6 and showing the desk top form to the device 50. It is also contemplated that the power switch may be actuated to activate the motor with the insertion of the nail end 24 into the groove 20 and/or that the power switch, such as that shown in FIG. 4, may be discretely manually actuated by the user to activate the motor.

Further, it is to be appreciated that in the electrically-powered embodiments of FIGS. 4 and 5, the flex provided by the arms 34, 36 in the manual version of FIG. 3B, is also provided via spring-biased arms 34, 36 that extend, or move apart, under bias tension, and can flex, or be brought closer together, as a user presses the nail 22 against the groove 20. At the ends of the spring-biased arms 34, 36, connective features of the handle 30, here shown as rollers 58, are provided to further help with the bi-directional lateral movement of the filing strip 10. As shown, the rotation of a wheel 60, via a motor axle 62 driven by the motor 54 (FIG. 5), causes right and left links 64, 66 to reciprocate back and forth, or to move laterally bi-directionally, in a slot 68, thereby making the filing strip 10 to similarly move, as ends 70, 72 thereof are rotatable mounted to respective one of the links 64, 66. Other devices for converting rotary motion to bi-directional lateral movement may also be used and envisioned with the present invention.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "significantly, " and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

What is claimed is:

1. A filing strip for filing an end of a human nail, the filing strip comprising a support portion, an abrasive portion, and at least two edge portions, wherein:

the support portion comprises only a single groove that extends at least partially along a longitudinal axis of the support portion, the support portion has a degree of flexibility sufficient to define a longitudinally extending curvature of the support portion which flexes under pressure applied with the insertion of the end of the human nail into the single groove such that the single groove wraps at least partially about the end of the human nail;

the abrasive portion is positioned within the single groove of the support portion and extends at least partially along the longitudinal axis of the support portion so as to file the end of the human nail inserted into the single groove and in contact with the abrasive portion; and the edge portions are positioned at least partially along an upper periphery and a lower periphery of the single groove, respectively, to define a depth of the single groove to limit the insertion of the human nail into the single groove and to ensure only the end of the nail and not surrounding flesh to the human nail is filed by the abrasive portion and a handle, wherein the support portion of the filing strip further comprises a connective feature disposed at each end thereof; the handle comprises a grip portion, at least two arms, and at least two connective features that complement the connective features of the filing strip, the filing strip is connected to the handle via the complementary connective features respective of the support portion and the handle.

2. The filing strip of claim 1, wherein the support portion further comprises at least one connective feature disposed at an end of the support portion to connect the filing strip to a filing device to facilitate the filing of the end of the human nail by the filing strip.

3. The filing strip of claim 1, wherein the abrasive portion comprises a measure of abrasion selected from the group consisting of: fine abrasion, medium abrasion, and coarse abrasion.

4. The filing strip of claim 1, wherein the abrasive portion comprises at least one of an abrasive material embedded in the support portion, an abrasive material adhered to the support portion, and a roughened, knurled, or sharp surface provided to the support portion.

5. The filing strip of claim 4, wherein the abrasive portion is an emery provided to the support portion.

6. The nail file of claim 1, wherein the connective features of the support portion are keyholes and the connective features of the handle are ball ends disposed on respective ends of the arms.

7. The nail file of claim 6, wherein:

the keyholes of the support portion respectively comprise a large arc portion interconnected with a small arc portion, and the arms of the handle comprise a degree of flexibility sufficient to permit the arms to flex such that the ball ends insert into the large arc portions of the keyholes and neck portions between the ball ends and the arms slide into the small arc portions of the keyholes with release of flexion of the arms such that the filing strip is removably connected to the handle.

8. The nail file of claim 1, wherein the arms of the handle comprise a degree of flexibility sufficient to facilitate the wrapping of the single groove of the support portion at least partially about the end of the human nail inserted therein.

9. The nail file of claim 1, wherein:

the nail file comprises an electrically powered motor inside of the handle and a power control switch at least partially exposed along an exterior surface of the handle, and the motor drives bi-directional lateral movement of the filing strip to file the end of the human nail.

10. The nail file of claim 9, wherein the nail file comprises a plug electrically coupled to the motor and the power switch and extending from the handle.

11. The nail file of claim 9, wherein the nail file comprises a battery receptacle electrically coupled to the motor and the power switch.

12. The nail file of claim 9, wherein the power switch is actuated to activate the motor and the bi-directional lateral movement of the filing strip with the insertion of the end of the human nail into the single groove of the support portion of the filing strip.

13. The nail file of claim 9, wherein the power switch is spring-biased and positioned beneath the filing strip such that the spring-biased power switch is substantially simultaneously depressed via a digit associated with the human nail to activate the motor with the insertion of the end of the human nail into the single groove of the support portion.

14. The nail file of claim 9, wherein the power switch is a manually actuated power switch.

15. A nail file for filing an end of a human nail, the nail file comprising:

a reusable handle, wherein the reusable handle comprises a grip portion and at least two connective features; and a flexible, disposable filing strip comprising a support portion, an abrasive portion, and at least two edge portions, wherein:

the support portion comprises only a single groove that extends at least partially along a longitudinal axis of the support portion and comprises at least two connective features disposed at ends of the support portion, the support portion has a degree of flexibility sufficient to define a longitudinally extending curvature of the support portion which flexes under pressure applied with the insertion of the end of the human nail into the single groove such that the single groove wraps at least partially about the end of the human nail;

the abrasive portion is positioned within the single groove of the support portion and extends at least partially along the longitudinal axis of the support portion so as to file the end of the human nail inserted into the single groove and in contact with the abrasive portion;

the edge portions are positioned at least partially along an upper periphery and a lower periphery of the single groove, respectively, to define a depth of the single groove to limit the insertion of the human nail into the single groove and to ensure only the end of the nail and not surrounding flesh to the human nail is filed by the abrasive portion; and the flexible, disposable filing strip is removably attached to the reusable handle via the connective features.

16. The nail file of claim 15, wherein the connective features of the reusable handle complement the connective features of the flexible, disposable filing strip.

* * * * *